US006045408A

United States Patent [19]

Takemasa

[11] Patent Number: 6,045,408

[45] Date of Patent: Apr. 4, 2000

[54] ELECTRICAL CONNECTOR HAVING FOLDED ELECTRICAL CONTACTS

[75] Inventor: Eiichiro Takemasa, Yokahama, Japan

[73] Assignee: The Whitaker Corporation, Wilmington, Del.

[21] Appl. No.: 09/174,035

[22] Filed: Oct. 16, 1998

[30] Foreign Application Priority Data

Oct. 23, 1997 [JP] Japan ..... 9-309322

[51] Int. Cl.[7] ..... H01R 17/00

[52] U.S. Cl. ..... 439/660; 439/733.1

[58] Field of Search ..... 439/660, 733.1, 439/869, 444, 884; 200/284

[56] References Cited

U.S. PATENT DOCUMENTS 5,338,231 8/1994 Wilhite ..... 439/660

FOREIGN PATENT DOCUMENTS 63-43279 2/1988 Japan ..... H01R 33/74
3-295181 12/1991 Japan ..... H01R 17/04
4-144082 5/1992 Japan ..... H01R 23/00
4-342974 11/1992 Japan ..... H01R 23/00
8-31486 2/1996 Japan ..... H01R 13/04
8-130067 5/1996 Japan ..... H01R 17/12
8-236226 9/1996 Japan ..... H01R 23/68

*Primary Examiner*—Khiem Nguyen
*Assistant Examiner*—Javaid Nasri

[57] ABSTRACT

The present invention provides an electrical contact which can be used in a board-mounted electrical connector and is capable of effecting resilient engagement with circuit pads on a circuit board. Electrical connector 10 has a plurality of electrical contacts 50 inside a housing 20. Each of the electrical contacts 50 has a first plate member 62 and a second plate member 63 which are formed by folding at one end on an engaging side. The first plate member 62 has a press-fitting section 53 and a resilient contact section 52 extending at an inclined angle. The second plate member 63 includes a pressing shoulder 66 used during press-fitting into a cavity of the housing. When the housing 20 is mounted on a circuit board, the contact sections 52 of the electrical contacts 50 flex resiliently at the bottom side of the housing 20, and termination sections 54 resiliently engage circuit pads on the circuit board.

18 Claims, 5 Drawing Sheets

22a
25
26a
50
50
21
10
23
26b
22b 22a
26b
40
25
27a
50
24
52
51
21
2
2
23
10
20
27a
26b
22b 26a
22a
27b
20
24
52
52
50
50
21
10
27a
22b
26b

ELECTRICAL CONNECTOR HAVING FOLDED ELECTRICAL CONTACTS

FIELD OF THE INVENTION

The present invention relates to an electrical contact, especially a male electrical contact used in an electrical connector mounted on a circuit board.

BACKGROUND OF THE INVENTION

One example of an electrical connector mounted on a circuit board is disclosed in Japanese Patent Application No. 8-236226 wherein the electrical connector comprises a pair of matable electrical connectors mounted on a circuit board. One of the connectors contains male electrical contacts which are mounted within a housing. The male electrical contacts are formed by bending metal plates into what is substantially an "L" shape. The electrical connectors must be soldered to the circuit board. Accordingly, the work of mounting the connectors on the circuit board is troublesome. Furthermore, the tines of the male electrical contacts must protrude to the outside of the housing in order to allow confirmation of the soldering, as a result, the mounted dimensions of the electrical connectors are relatively large.

Another example of an electrical contact of a type which resiliently engages the circuit board is disclosed in Japanese Patent Application No. 63-43279. However, the electrical contact is not a male contact; furthermore, the housing in which the contact is accommodated has relatively large dimensions, and the number of parts is also large so that assembly is difficult and time consuming.

Accordingly, an object of the present invention is to provide an electrical contact, which is caused to make resilient engagement with circuit pads on a circuit board, which is easy to assemble and which makes it possible to obtain highly reliable electrical connections, and which makes it possible to minimize the dimensions of the housing in which the contact is accommodated.

SUMMARY OF THE INVENTION

The present invention is directed to an electrical contact formed from a metal plate and is press-fitted in a housing of an electrical connector which is to be mounted on a circuit board. The electrical contact comprises a first plate member including a contact section that resiliently engages the circuit board, and a second plate member including a pressing shoulder used during press-fitting into the housing. The second plate member is formed by folding back the metal plate, and the second plate member in the vicinity of an end that is folded back is used as a contact member for electrical connection with a mating electrical contact.

An electrical contact for insertion into and retention in a cavity of a dielectric housing comprises a first plate member and a second plate member connected together at one end by folding the plate members back upon one another so that the plate members are disposed at a slight angle; an inclined-contact section at an outer end of the first plate member; and a securing section provided by the first plate member adjacent the inclined-contact section so that the securing section engages a wall of the cavity when the electrical contact is inserted into the cavity thereby securing the electrical contact in the cavity and causing the plate members to extend along one another defining a contact member.

DETAILED DESCRIPTION OF THE INVENTION

Figures 1A, 1B, 1C:
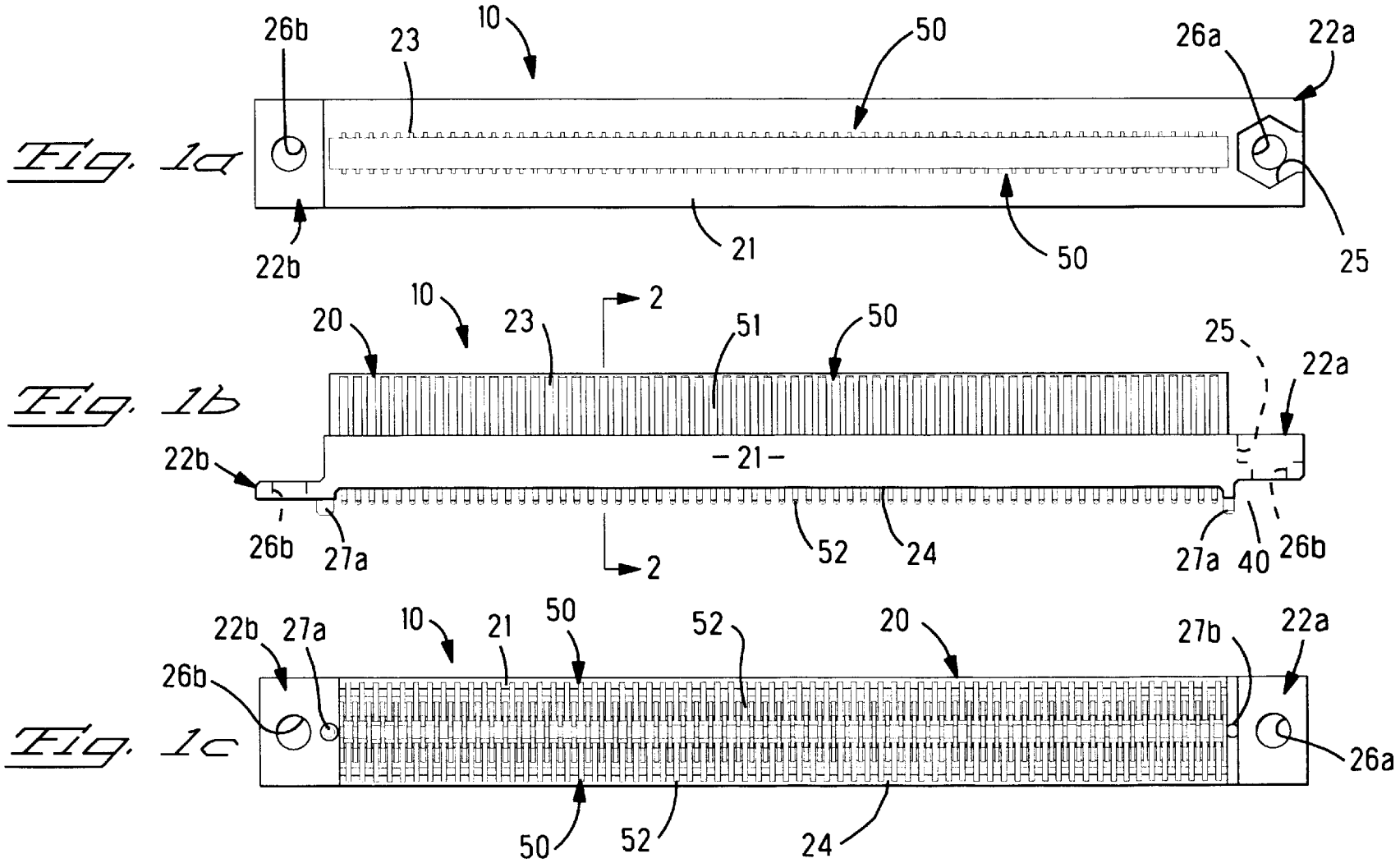
FIGS. 1*a*–1*c* illustrate an electrical connector containing electrical contacts of the present invention with FIG. 1*a* being a plan view, FIG. 1*b* a front view, and FIG. 1*c* a bottom view.

As shown in FIGS. 1*a*–1*c,* electrical connector 10 has a substantially long, slender dielectric housing 20 and a plurality of electrical contacts 50 supported in housing 20. The housing 20 has a base section 21, screw-accommodating sections 22*a,* 22*b* located at both ends of the base section 21, and a protruding section 23, which protrudes from the base section 21. The screw-accommodating section 22*a* is formed in a relatively high position in the direction of height, so that a space 40 is located on the bottom side of the screw-accommodating section 22*a*.

The screw-accommodating section 22*a* has a bolt-accommodating portion 25 and a through-hole 26*a* which communicates with bolt-accommodating portion 25. On the other hand, the screw-accommodating section 22*b* is formed in a relatively low position in the direction of height, and it has a through-hole 26*b*. The space 40 is formed with dimensions which allow the accommodation of the screw-accommodating section 22*b,* so that two electrical connectors 10 can be connected in the direction of length of the housings 20 and fastened to a surface of a circuit board by overlapping the screw-accommodating section 22*a* of one connector with the screw-accommodating section 22*b* of another connector and accommodating the same bolt screw (not shown) in the through-hole 26*a* and through-hole 26*b*. Furthermore, positioning posts 27*a,* 27*b* are used to position the housing 20 on the circuit board, and they are located on bottom surface 24 of the housing 20.

Electrical contacts 50 are disposed in two rows inside the housing 20, and they are disposed in two rows on both sides of the protruding section 23. Contact members 51 of the electrical contacts 50 are positioned along both side surfaces of the protruding section 23, and contact sections 52, which possess resiliency, are disposed along the bottom surface 24 of the housing 20.

Figure 2:
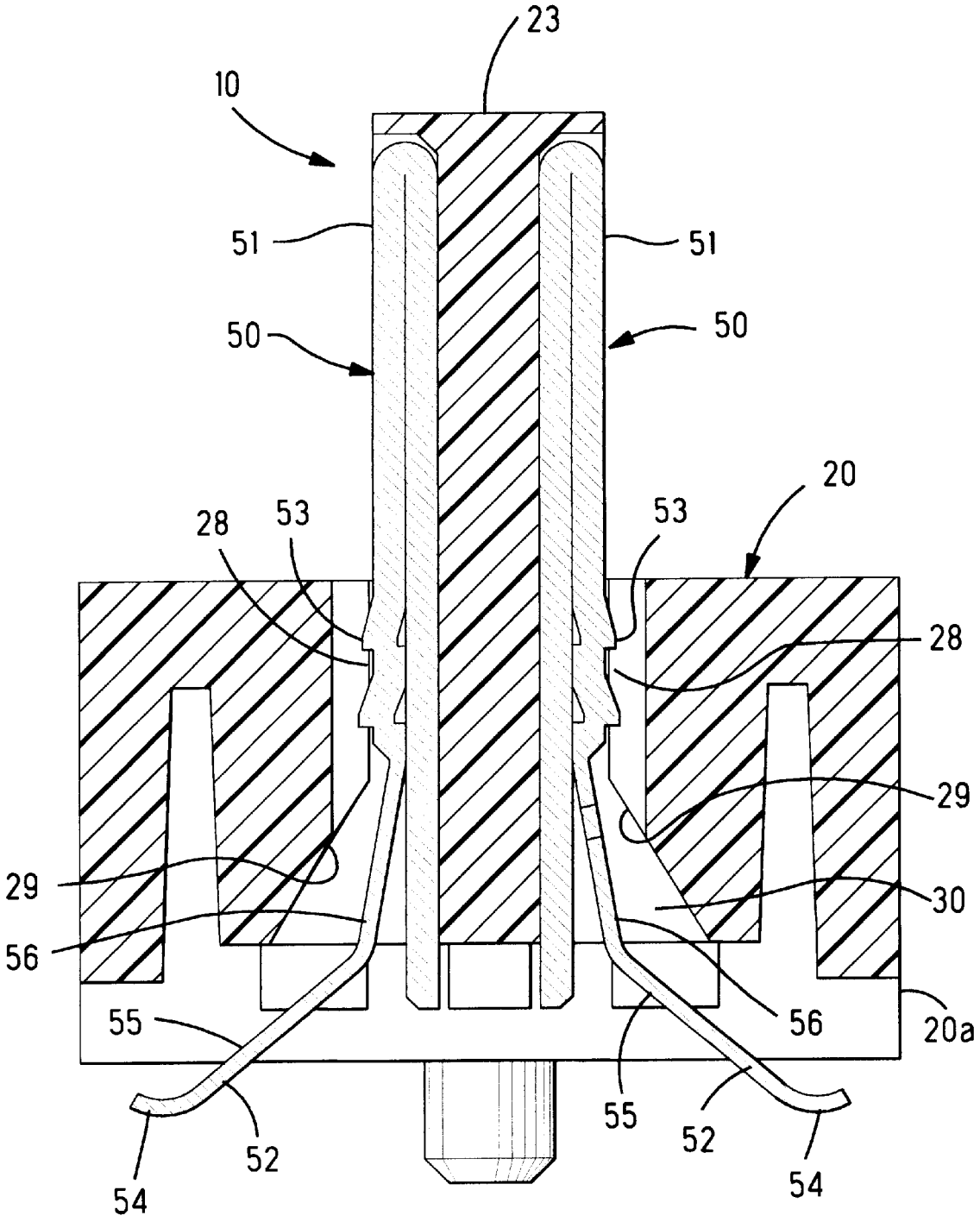
FIG. 2 is a cross-sectional view taken along line 2—2 in FIG. 1*b*.
Figure 6:
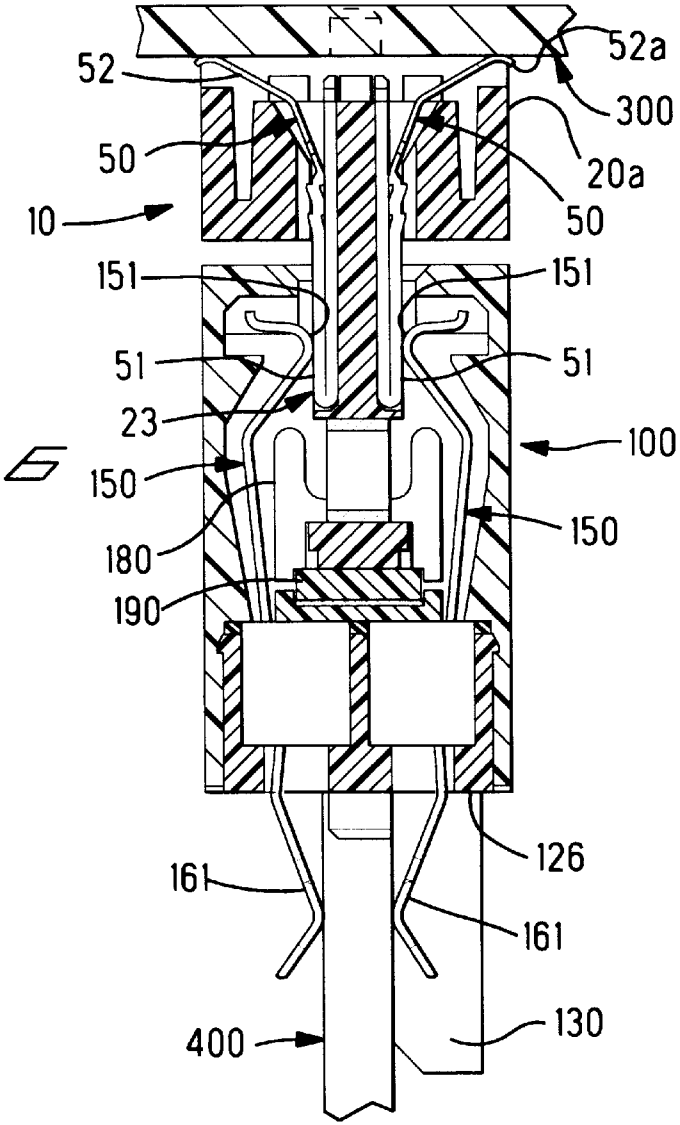
FIG. 6 is a cross-sectional view which shows the state of engagement between the electrical connector shown in FIGS. 1 and 2 and the mating connector shown in FIGS. 4 and 5.

The disposition of the electrical contacts 50 is shown in detail in FIG. 2. The respective electrical contacts 50 are disposed back-to-back on both sides of the protruding section 23. Press-fitting sections 53 are located in intermediate positions on the electrical contacts 50, and the electrical contacts 50 are fastened in place by the press-fitting of the press-fitting section 53 in cavities 28 in the housing 20. Recesses 30, which include inclined surfaces 29, are located adjacent the bottoms of the cavities 28. As shown in FIG. 2, the contact section 52 of each electrical contact 50 has a first portion 55, which is gradually inclined in the vicinity of a termination section 54, and a second portion 56, which is more steeply inclined. When the contact section 52 engages the circuit board, the contact section 52 flexes; however, the recess 30 allows the displacement of the second portion 56 therein. In FIG. 6, which will be described later, a state in which the electrical connector 10 is connected to a circuit board 300, and in which the contact sections 52 are in engagement with circuit pads (not shown) on the circuit board 300, is shown. In the case of such engagement, the ends 52*a* of the contact sections 52 reach the side surfaces 20*a* of the housing 20.

Figure 3A:
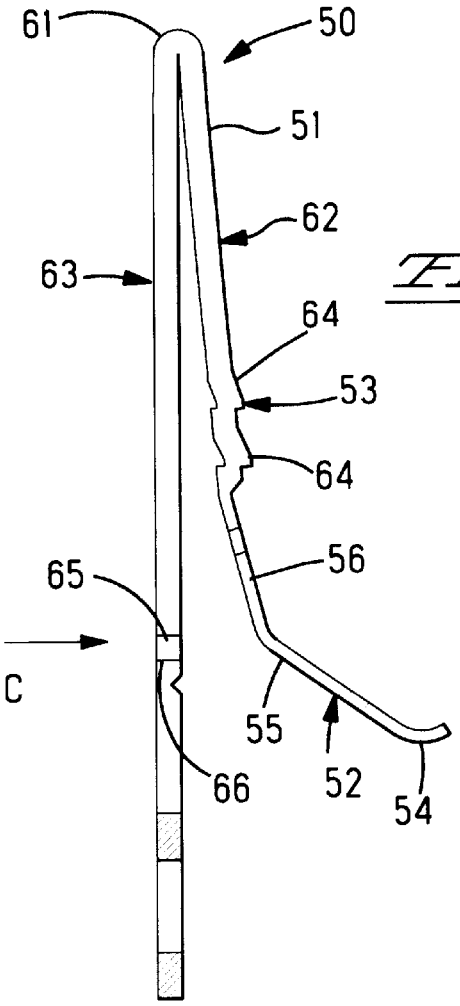
FIGS. 3*a* and 3*b* show the electrical contacts together with a carrier with FIG. 3*a* being a side view prior to press-fitting into the housing, and FIG. 3*b* a front view.
Figure 3B:
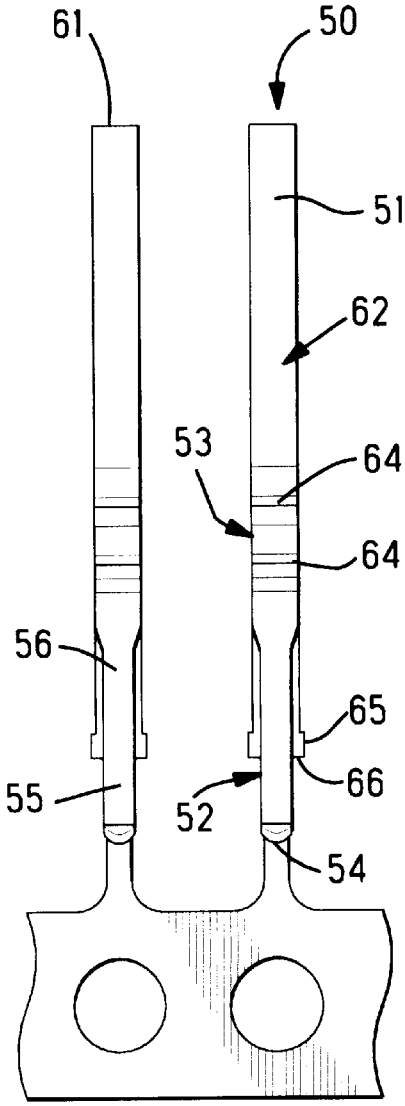

The electrical contact 50, as shown in FIGS. 3*a* and 3*b*, has a first plate member 62 and a second plate member 63, which are disposed relative to one another by folding a metal plate back at one end 61. Prior to press-fitting, as shown in FIG. 3*a*, the first plate member 62 and second plate member 63 are in a state in which the plate members are disposed at a slight angle. The first plate member 62 includes contact section 52 and a press-fitting or securing section 53. The contact section 52 is formed by a method such as coining, so that the contact section 52 has a relatively small thickness and a relatively narrow width. The contact section 52 has a first portion 55 and second portion 56 which have different angles of inclination. The press-fitting section 53, which is press-fitted in the cavity 28 of the housing 20, has two projecting members 64, which are formed by stamping so that they protrude in a direction generally perpendicular to the plate surface. Furthermore, as shown in FIG. 3*b*, the termination section 54 of the contact section 52 is bent so that termination section 54 describes a circular arc in the direction of width of the plate so as to have an arcuate configuration. The second plate member 63 extends in a straight line. The second plate member 63 has a pressing shoulder 66 which is delineated by protruding members 65 that protrude on both sides thereof.

The electrical contact 50 is pressed into the housing 20 and fastened in place by pressing the pressing shoulder 66 of the second plate member 63 by means of a jig (not shown). As seen by referring to FIG. 2, the first plate member 62 and second plate member 63 are generally tightly closed inside the cavity 28 when press-fitting is completed so that the plate members extend along one another.

Figures 4A, 4B, 4C:
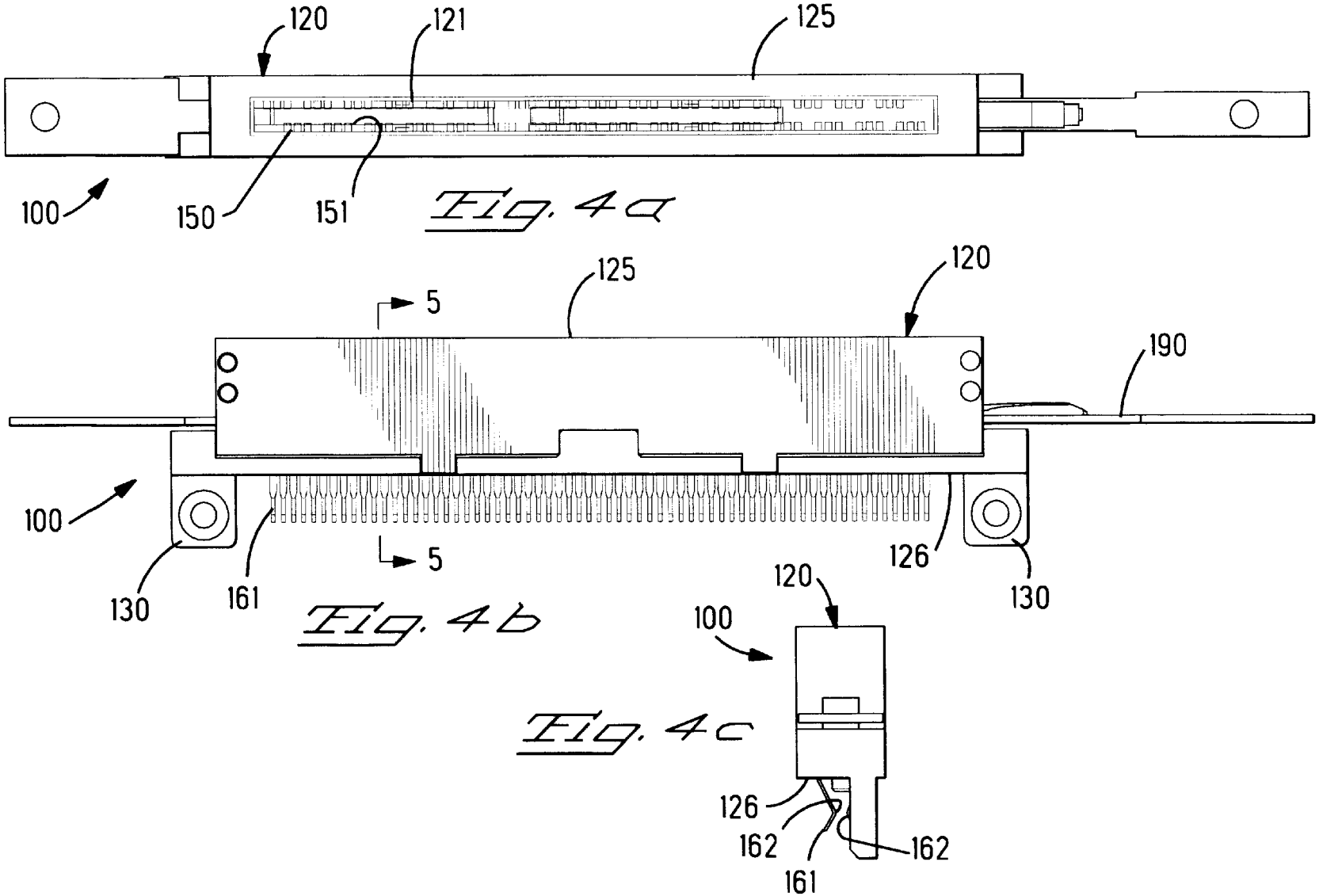
FIGS. 4*a*–4*c* show a mating connector which mates with the electrical connector shown in FIGS. 1 and 2 with FIG. 4*a* being a plan view, FIG. 4*b* a front view, and FIG. 4*c* a left-side view of FIG. 4*b*.
Figure 5:
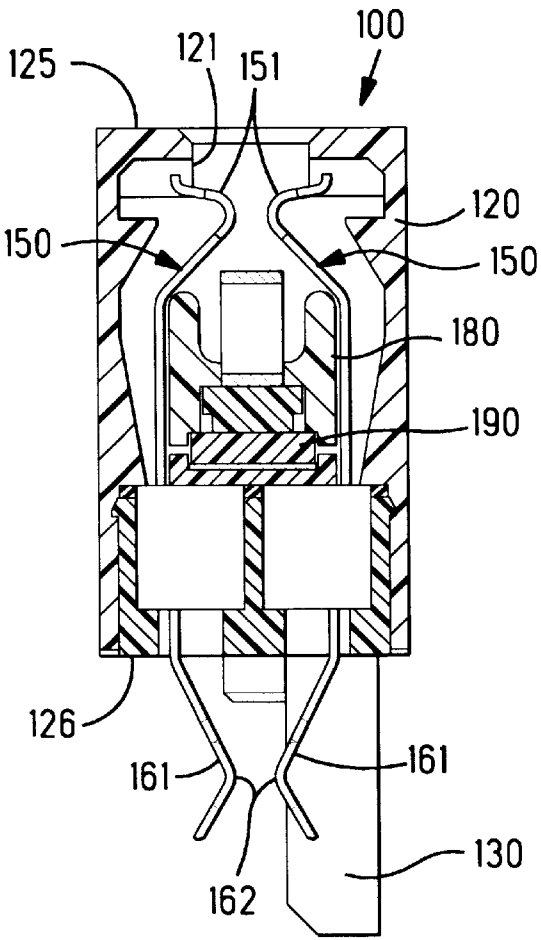
FIG. 5 is a cross-sectional view taken along line 5—5 in FIG. 4*b*.

As shown in FIGS. 4*a*–4*c*, the mating connector 100 has electrical contacts 150 and a dielectric housing 120 in which contacts 150 are accommodated. A recess 121 in housing 120 accommodates the electrical connector 10. Female contact sections 151 of the contacts 150, which engage the contact members 51 of the electrical contacts 50 of the electrical connector 10, are disposed in two opposing rows inside the recess 121. The recess 121 is formed with dimensions which allow the accommodation of a plurality of electrical connectors 10 connected via the screw-accommodating sections 22*a* and 22*b*. A zero-insertion force structure is utilized for the engagement of the electrical connectors 10 and mating connector 100. As shown in FIG. 5, the zero-insertion force structure includes a cam member 180, which moves in the direction of engagement, and a lever member 190, which actuates the cam member 180. The operating principle of this structure is disclosed in Japanese Patent Application No. 3-295181, Japanese Patent Application No. 4-144082 and Japanese Patent Application No. 4-342974; accordingly, a description of such structure is omitted here. In the engaged state, as shown in FIG. 6, the recess 121 of the mating connector 100 accommodates the protruding section 23 of the electrical connector 10, and the female contact sections 151 engage the contact members 51 positioned on both sides of the protruding sections 23.

As shown in FIGS. 4*a*–4*c* and 5, the mating connector 100 is constructed so that a circuit board can be accommodated on the opposite side from the engaging side 125. Resilient contact members 161 of the contacts 150 are disposed along a bottom surface 126 of the housing 120. The resilient contact members 161 are arranged in two rows, and have opposing contact points 162. The resilient contact members 161 accommodate a circuit board between the rows, and the contact points 162 resiliently engage respective circuit pads located on both sides of circuit board 400 so that electrical connections are realized therebetween. The accommodated circuit board 400 is also shown in FIG. 6. The circuit board 400 is screw-fastened to screw-fastening sections 130, which are disposed near both ends of the opposite side of the mating connector 100 from the engaging side 125.

An electrical connector of the present invention has been described above; however, it is merely an example. Various modifications or alterations may be made by a person skilled in the art. For example, various existing types of fastening means may be used as the housing-fastening means. Furthermore, metal members used for reinforcement may be disposed along the inside or outside surfaces of the housing accommodating the electrical contacts in the present embodiment, with the outside shape and dimensions remaining substantially the same.

The electrical contact of the present invention comprises a first plate member having a contact section that resiliently engages a circuit board, and a second plate member including a pressing shoulder used during press-fitting into a cavity of a housing. The plate members are integrally connected at one end by folding them back upon one another thereby forming a contact member for electrical connection with a mating contact. Accordingly, highly reliable electrical connections with a circuit board can be obtained, and assembly can easily be accomplished. Furthermore, the housing in which the contacts are accommodated can be formed with minimal dimensions. Furthermore, the electrical contact of the present invention also offers the following economic advantage: i. e., the efficiency of material utilization is good, so that the electrical contact can be manufactured relatively inexpensively.

I claim:

1. An electrical contact for insertion into and retention in a cavity of a dielectric housing, comprising a first plate member and a second plate member connected together at one end by folding the plate members back upon one another so that the plate members are disposed at a slight angle;

an inclined-contact section at an outer end of the first plate member; and a securing section provided by the first plate member adjacent the inclined-contact section so that the securing section engages a wall of the cavity when the electrical contact is inserted into the cavity thereby securing the electrical substantially rigid contact in the cavity and causing the plate members to extend along one another defining a contact member.

2. The electrical contact as claimed in claim 1, wherein said inclined-contact section includes a first portion and a second portion.

3. The electrical contact as claimed in claim 2, wherein the second portion is inclined at a greater angle than said first portion.

4. The electrical contact as claimed in claim 1, wherein the securing section includes spaced projecting members.

5. The electrical contact as claimed in claim 2, wherein an outer end of said second portion defines a termination section having an arcuate configuration.

6. An electrical connector, comprising a dielectric housing having contact-receiving cavities;

electrical contacts disposed in the contact-receiving cavities, each of the electrical contacts including a first plate member and a second plate member connected at one end and extending along one another within the contact-receiving cavity thereby defining a substantially rigid contact member for electrical engagement with a mating contact, an inclined-contact section at an outer end of the first plate member including a termination section at a free end thereof extending outwardly from a bottom surface of the dielectric housing, and a securing section on the contact member engaging a wall of the contact-receiving cavity thereby securing the electrical contact within the contact-receiving cavity and causing the plate members to extend along one another.

7. The electrical connector as claimed in claim 6, wherein the housing has a protruding section along which the contact members of the electrical contacts extend.

8. The electrical connector as claimed in claim 6, wherein the contact-receiving cavities have recesses including inclined surfaces in which the inclined-contact sections are disposed.

9. The electrical connector as claimed in claim 8, wherein the inclined-contact sections include first portions and second portions.

10. The electrical connector as claimed in claim 9, wherein the second portions are inclined at a greater angle than the first portions.

11. The electrical connector as claimed in claim 6, wherein the termination sections have an arcuate configuration.

12. The electrical connector as claimed in claim 6, wherein the housing has opposing sides and the termination sections do not extend beyond the sides of the dielectric housing.

13. The electrical connector as claimed in claim 6, wherein the securing section is located on the first plate member and has spaced projecting members.

14. The electrical connector as claimed in claim 13, wherein the projecting members are generally perpendicular to said first plate member.

15. An electrical contact for insertion into and retention in a cavity of a dielectric housing having a protruding section, comprising a first plate member and a second plate member connected together at one end by folding the plate members back upon one another so that the first plate member is disposed at an angle with respect to the second plate member;

an inclined-contact section at an outer end of the first plate member; and a securing section on the first plate member at a junction of the first plate member and the inclined-contact section so that when the electrical contact is inserted into the cavity, the second plate member extends along a surface of the protruding section, the securing section engages a wall of the cavity thereby securing the electrical contact in the cavity, causing the first plate member to extend along the second plate member with the first plate member defining a contact member and the inclined contact section being inclined with respect to the second plate member.

16. The electrical contact of claim 15, wherein the inclined-contact section includes a first portion and a second portion; the second portion is inclined at a greater angle than the first portion.

17. The electrical contact of claim 15, wherein the securing section includes spaced projecting members.

18. The electrical contact of claim 15, wherein an outer end of the inclined-contact section defines a termination section extending below a bottom surface of the dielectric housing and having an arcuate configuration.

* * * * *